US005559526A

United States Patent [19]

Izawa

[11] Patent Number: 5,559,526

[45] Date of Patent: Sep. 24, 1996

[54] LIQUID CRYSTAL DISPLAY HAVING A DRIVE CIRCUIT

[75] Inventor: Mitsuharu Izawa, Tokyo, Japan

[73] Assignee: Casio Computer Co., Ltd., Tokyo, Japan

[21] Appl. No.: 249,078

[22] Filed: May 25, 1994

Related U.S. Application Data

[63] Continuation of Ser. No. 40,463, Apr. 1, 1993, abandoned.

[30] Foreign Application Priority Data

Apr. 9, 1992 [JP] Japan ..... 4-088586

[51] Int. Cl.[6] ..... G09G 3/36

[52] U.S. Cl. ..... 345/96; 345/95; 345/100

[58] Field of Search ..... 345/96, 98, 99, 345/100, 90, 92, 94, 205, 206

[56] References Cited

U.S. PATENT DOCUMENTS

| | | | |
|---|---|---|---|
| 4,429,305 | 1/1984 | Hosokawa | 340/784 |
| 5,017,914 | 5/1991 | Uchida | 340/784 |
| 5,091,784 | 2/1992 | Someya | 340/784 |
| 5,115,232 | 5/1992 | Iizuka | 340/784 |
| 5,162,786 | 10/1992 | Fukuda | 340/784 |
| 5,220,313 | 6/1993 | Kumazawa et al. | 345/98 |

FOREIGN PATENT DOCUMENTS 62-148928 2/1987 Japan .

OTHER PUBLICATIONS

Lewis, W; Goodheart C. "Basic Electric Circuit Theory" Ronald Press. New York. 1958. pp. 534–535.

Mims, Forrest. "Engineer's Notebook." pp. 12,13,15,77. 1980.

*Primary Examiner*—Richard Hjerpe

*Assistant Examiner*—Xiao M. Wu

*Attorney, Agent, or Firm*—Frishauf, Holtz, Goodman, Langer & Chick

[57] ABSTRACT

An active-matrix liquid crystal display has a drive circuit for driving thin-film transistors. The drive circuit comprises a shift register transmitting a sequence of image data for a single scanning line, latch circuits, tristate output circuits, pixel electrodes, and switching devices each turning on and off a pixel electrode. Each tristate output circuit has an control terminal and an input terminal. When the level of a image data received by the control terminal is high, the tristate output circuit, in response to a high or low potential of a frame signal received by the input terminal, outputs a high or low potential respectively different from those of the frame signal. The switching devices enable the output potential of each tristate output circuit to be charged in the pixel electrodes. During the charge time, the shift register transmits a next sequence of image data.

10 Claims, 6 Drawing Sheets

LIQUID CRYSTAL DISPLAY HAVING A DRIVE CIRCUIT

This application is a continuation of application Ser. No. 08/040,463, filed Apr. 1, 1993, abandoned.

BACKGROUND OF THE INVENTION

1. Field of the Invention

The present invention relates to a liquid crystal display having a drive circuit formed on one of a pair of glass base plates:.

2. Description of the Related Art

There is known an active-matrix liquid crystal display in which one of a pair of transparent glass electrode base plates for sealing liquid crystal therebetween has switching thin-film transistors formed thereon. Recently, such an active-matrix liquid crystal display in which one of the pair of the glass electrode base plates also has a drive circuit mounted thereon for driving the switching thin-film transistors has been developed.

FIG. 5 shows a prior-art drive circuit of the liquid crystal display. FIG. 6 is a timing chart showing of the drive timings of components of the drive circuit shown in FIG. 5.

Each of thin-film transistors TFT and load capacitors LC are connected in series between each of data lines L201 and L202 and a common or ground potential $V_{COM}$. A gate of each thin-film transistor TFT is connected to a corresponding gate line L301 or L302. Each of the gate lines L301 and L302 is connected through an invertor IN to a scanning shift register 1. The scanning shift register 1 receives a vertical synchronizing signal $\phi_v$ and a vertical clock pulse $CP_v$ from an external circuit (not shown). The scanning shift register 1 provides horizontal scanning signals G1 and G2 to the gate lines L301 and L302 in response to the vertical synchronizing signal $\phi_v$ and the vertical clock pulse $CP_v$ to horizontally scan the gate lines L301 and L302 and turn on thin-film transistors TFT.

Flip-flops FF101 and FF102 constitute a data line shift register. A data input terminal D of the flip-flop FF101 receives a horizontal synchronizing signal $\phi_h$. An output terminal Q of the flip-flop FF101 is connected to a data input terminal D of a subsequent flip-flop FF102 and via an invertor IN101 to a control terminal $\overline{L}$ of a latch circuit LA101. An output terminal Q of the flip-flop FF102 is connected to a data input terminal of a subsequent flip-flop (not shown) and via an invertor IN102 to a control terminal $\overline{L}$ of a latch circuit LA102. A clock terminal of each of the flip-flops FF101 and FF102 receives a horizontal clock pulse $CP_h$. Input terminals I of the latch circuits LA101 and LA102 are connected to an output terminal of an exclusive NOR circuit ENOR. Respective input terminals of the exclusive NOR circuit ENOR receive frame signals FRM and video signals DATA. An output terminal 0 of the latch circuit LA101 is connected to the data line L201. An output terminal 0 of the latch circuit LA102 is connected to the data line L202.

The flip-flops FF101 and FF102 of the data line shift register sequentially transmit the horizontal synchronizing signal $\phi_h$ on the horizontal clock pulse $CP_h$ and provide it to the control terminals $\overline{L}$ of the latch circuits LA101 and LA102 via the invertors IN101 and IN102. The input terminals I of the latch circuits LA101 and LA102 receive exclusive NOR data of the frame signals FRM and the video signals DATA. The latch circuits LA101 and LA102 sequentially receive and latch the exclusive NOR data of the frame signals FRM and the video signals DATA in response to control synchronization signals provided to the control terminals $\overline{L}$ thereof and then output the exclusive NOR data to the data lines L201 and L202. Every time the latch circuits LA101 and L102 for a single scanning line have received and latched the exclusive NOR data, the scanning shift register 1 sequentially provides the horizontal scanning signals G1 and G2 to the gate lines L301 and L302 to select thin-film transistors TFT and cause corresponding pixel capacitors LC to store signal charges via the selected thin-film transistors TFT.

In the above-described drive circuit, the horizontal scanning signals G1 and G2, as shown in the timing chart of FIG. 6, open the gates of the thin-film transistors TFT after the latch circuits LA101 and LA102 of the single scanning line have received the video signals DATA. That is, the opening of the gates of the thin-film transistors TFT is shifted in timing from a transfer of the video signals DATA. As well known, the carrier mobility of a thin-film transistor is far lower than that of a single crystal transistor. Therefore, it is difficult to provide multistage flip-flops when a drive circuit of the liquid crystal display comprises thin-film transistors. In other words, it is difficult to increase the definition of the display screen.

SUMMARY OF THE INVENTION

Therefore, an object of the present invention is to provide a liquid crystal display comprising a data line driver which can be made multistage and shift next data for a single scanning line even during opening of the gates of switching thin-film transistors, so that the liquid crystal display increases the definition of its screen.

In order to achieve the object, the liquid crystal display comprises a pair of base plates, a liquid crystal sealed in between the base plates, a plurality of data lines and a plurality of address lines formed on a surface of one of the base plates, a plurality of pixel electrodes placed near the intersections of the data lines and the address lines, a plurality of switching devices each connected to one of the data lines, one of the address lines and one of the pixel electrodes, and a peripheral circuit means mounted on either of the base plates, the peripheral circuit means including a shift circuit means for sequentially shifting image data for the single scanning line, a latch circuit means for latching the image data for the single scanning line, a switching means for providing a high or low potential to the data lines in response to the image data, and means for providing data for the single scanning line to then shift circuit means when the switching means provides the high or low potential to the data lines.

Other objects, features and advantages of the present invention will be apparent from a consideration of the following description, taken in connection with the accompanying drawings.

DESCRIPTION OF THE PREFERRED EMBODIMENT

A preferred embodiment of the present invention will be described with reference to the drawings hereinafter.

Figure 3A:
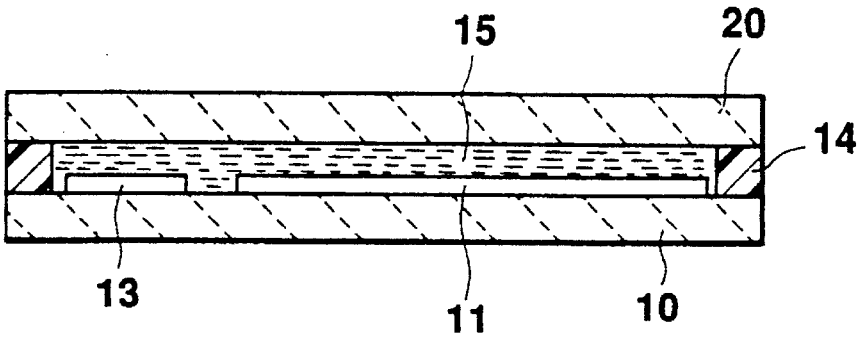
FIG. 3A is an enlarged cross section of the liquid crystal display having the drive circuit of FIG. 1 mounted therein.
Figure 3B:
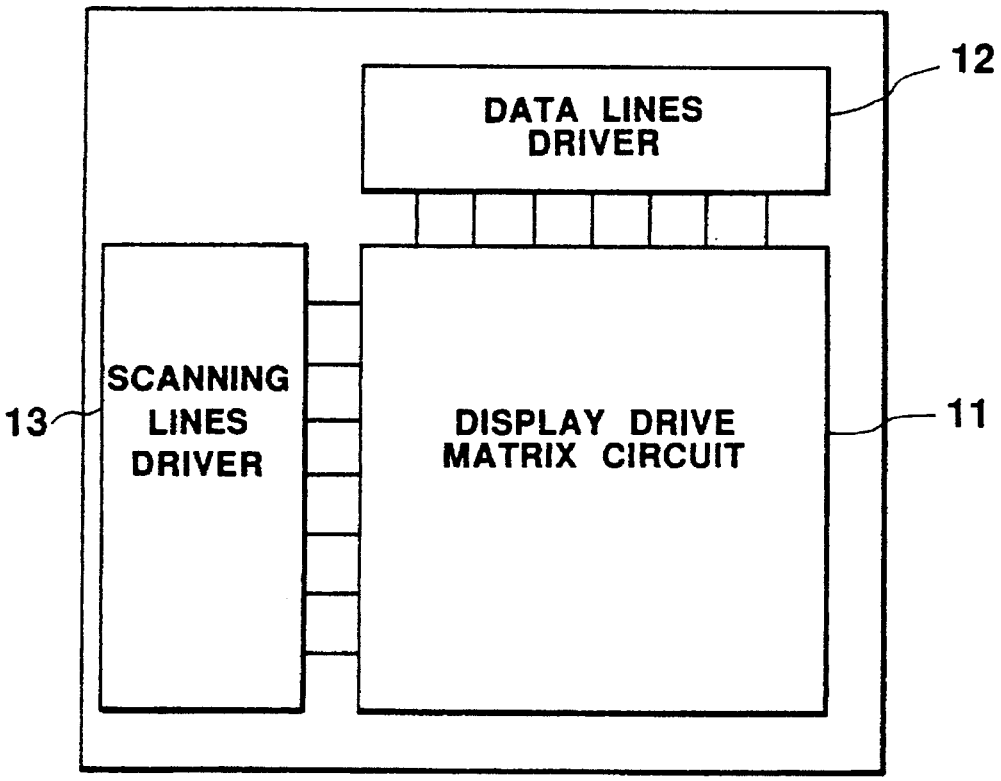
FIG. 3B is a plan view of a layout of the drive circuit formed on one of a pair of base plates of the liquid crystal display of FIG. 3A.

FIG. 3A is an enlarged cross section of a liquid crystal display having a drive circuit according to an embodiment of the present invention. The liquid crystal display comprises a pair of parallel base plates 10 and 20 made of a transparent glass. A sealer 14 seals the peripheries of the glass base plates 10 and 20. Liquid crystal 15 fills the interior of the assembly of the glass base plates 10 and 20 and the sealer 14. The interior surface of the glass base plate 20 has a transparent common electrode (not shown) and an aligning film (not shown) formed thereon. The interior surface of the glass base plate 10 has a plurality of transparent lines (not shown) formed thereon and extending in rows and columns. The interior surface of the glass base plate 10 also has a display drive matrix circuit 11 formed thereon and peripheral circuits formed thereon and driving the display drive matrix circuit 11. FIG. 3B shows a layout of the display drive matrix circuit 11 and the peripheral circuits formed on the glass base plate 10. A signal or data lines driver 12 is arranged to one side of the display drive matrix circuit 11. A scanning lines driver 13 is arranged to an adjoining side of the display drive matrix circuit 11. All of the display drive matrix circuit 11, the data lines driver 12 and the scanning lines driver 13 comprise thin-film transistors.

Figure 1:
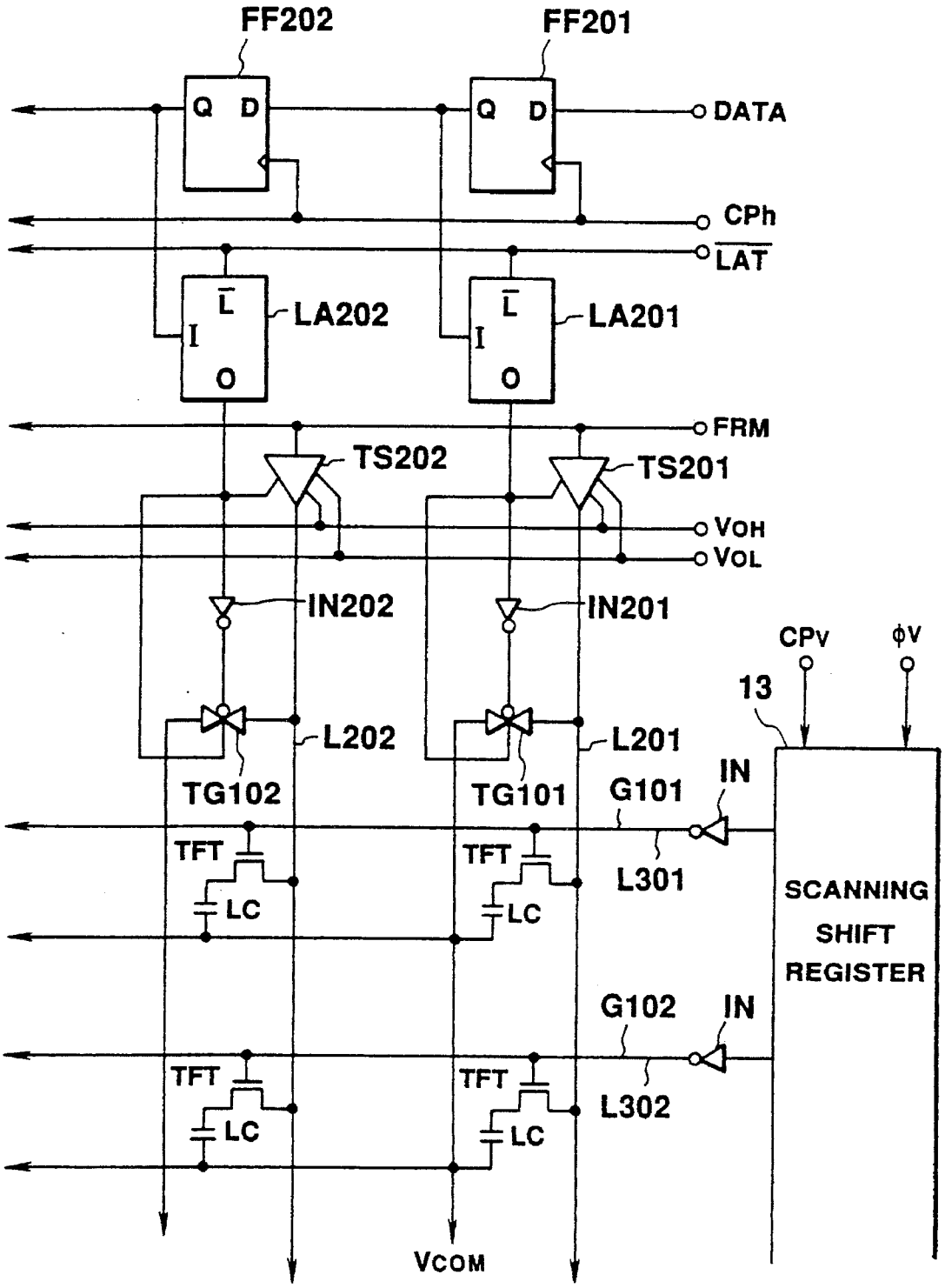
FIG. 1 is a diagram of an entire drive circuit of a liquid crystal display according to an embodiment of the present invention.
Figure 2:
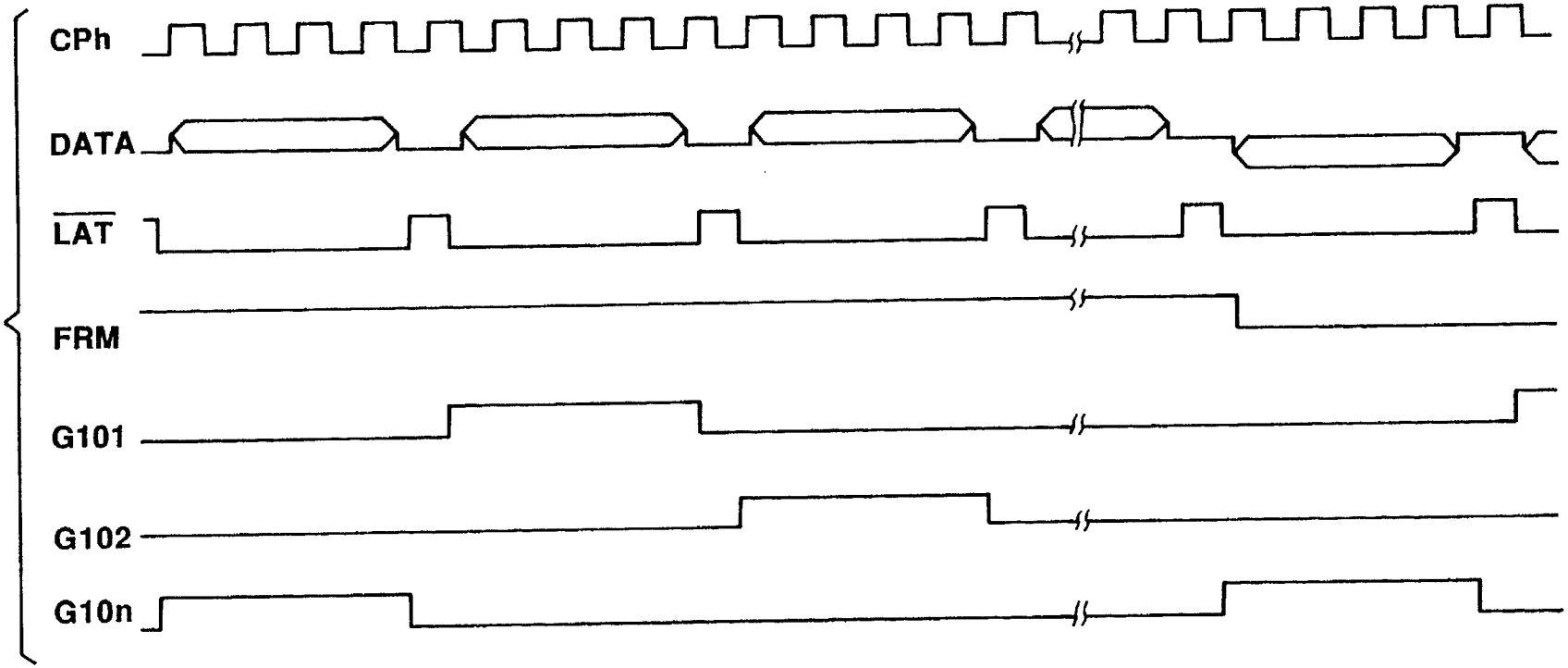
FIG. 2 is a timing chart showing of the timings of driver signals for components of the drive circuit of FIG. 1.

FIG. 1 shows an embodiment of the drive circuit of the liquid crystal display comprising the display drive matrix circuit 11, the data lines driver 12 and a scanning shift register 13*a* employed in the scanning lines driver 13 of FIG. 3B. FIG. 2 is a timing chart of the timings of driver signals for components of the drive circuit of the liquid crystal display of FIG. 1.

As shown in FIG. 1, a thin-film transistor TFT and a pixel capacitor LC are connected in series between each of data lines L201 and L202 and a common or ground potential $V_{COM}$. A gate of each thin-film transistor TFT is connected to a corresponding gate line L301 or L302. Each of the gate lines L301 and L302 is connected via an invertor IN to a scanning shift register 13*a*. The scanning shift register 13*a* receives a vertical synchronizing signal $\phi_v$ and a vertical clock pulse $CP_v$ from an external circuit (not shown). The scanning shift register 13*a* provides horizontal scanning signals G101 and G102 to the gate lines L301 and L302 in response to the vertical synchronizing signal $\phi_v$ and the vertical clock pulse $CP_v$ to horizontally scan the gate lines L301 and L302 and turn on thin-film transistors TFT.

Flip-flops FF201 and FF202 constitute a data line shift register. A data input terminal D of the flip-flop FF201 receives image data DATA in the form of digital data which correspond to video signals. An output terminal Q of the flip-flop FF201 is connected to a data input terminal D of a subsequent flip-flop FF202 and an input terminal I of a latch circuit LA201. An output terminal Q of the flip-flop FF202 is connected to an input terminal of a subsequent flip-flop (not shown) and an input terminal I of a latch circuit LA202. Other pairs (not shown) of flip-flops and latch circuits are connected in series as described above so that the series of the flip-flops and the latch circuits constitute the data line shift register for the single horizontal scanning line.

Clock terminals of the flip-flops FF201 and FF202 receive a horizontal clock pulse $CP_h$. Control terminals $\overline{L}$ of the latch circuits LA201 and LA202 receive a latch signal $\overline{LAT}$. Output terminals 0 of the respective latch circuits LA201 and LA202 are connected to control terminals of tristate output circuits TS201 and TS202, input terminals of invertors IN201 and IN202 and P-side control terminals of transfer gates TG101 and TG102.

Output terminals of the respective invertors IN201 and IN202 are connected to N-side control terminals of the transfer gates TG101 and TG102. Input terminals of the respective tristate output circuits TS201 and TS202 receive frame signals FRM which alternately are positive or negative every frame. Outputs of the respective tristate output circuits TS201 and TS202 are connected to the data lines L201 and L202. The outputs of the respective tristate output circuits TS201 and TS202 also are connected to a common or ground potential $V_{COM}$ via the transfer gates TG101 and TG102. The respective tristate output circuits TS201 and TS202 have high-voltage power terminals and low-voltage power terminals. The high-voltage power terminals of the tristate output circuits TS201 and TS202 receive a high voltage $V_{OH}$. The low-voltage power terminals of the tristate output circuits TS201 and TS202 receive a low voltage $V_{OL}$.

Figure 4:
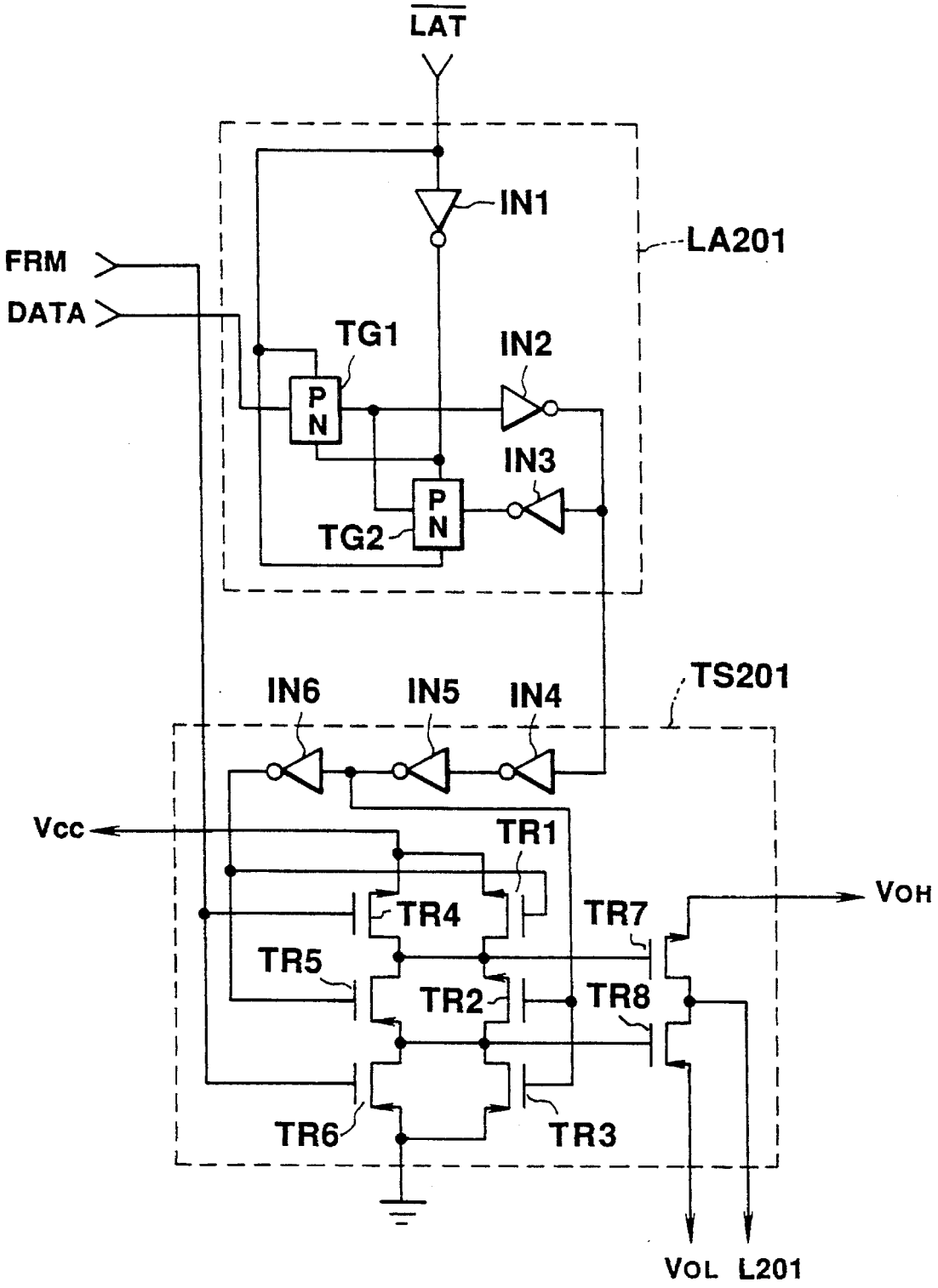
FIG. 4 is a detailed diagram illustrative of the latch circuits and the tristate output circuits of FIG. 1.
Figure 5:
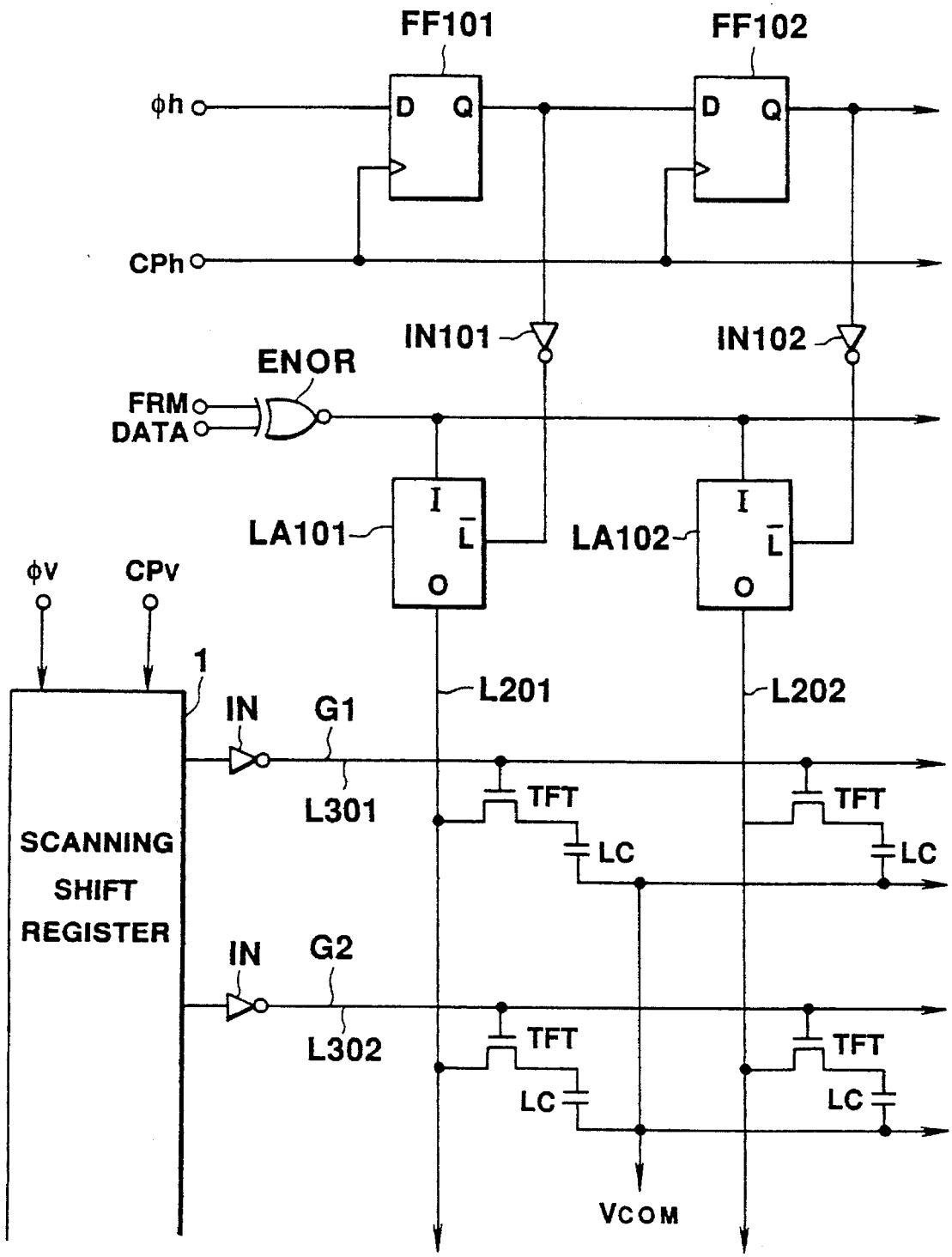
PRIOR ART FIG. 5
FIG. 5 is a diagram of a prior art drive circuit of a liquid crystal display.
Figure 6:
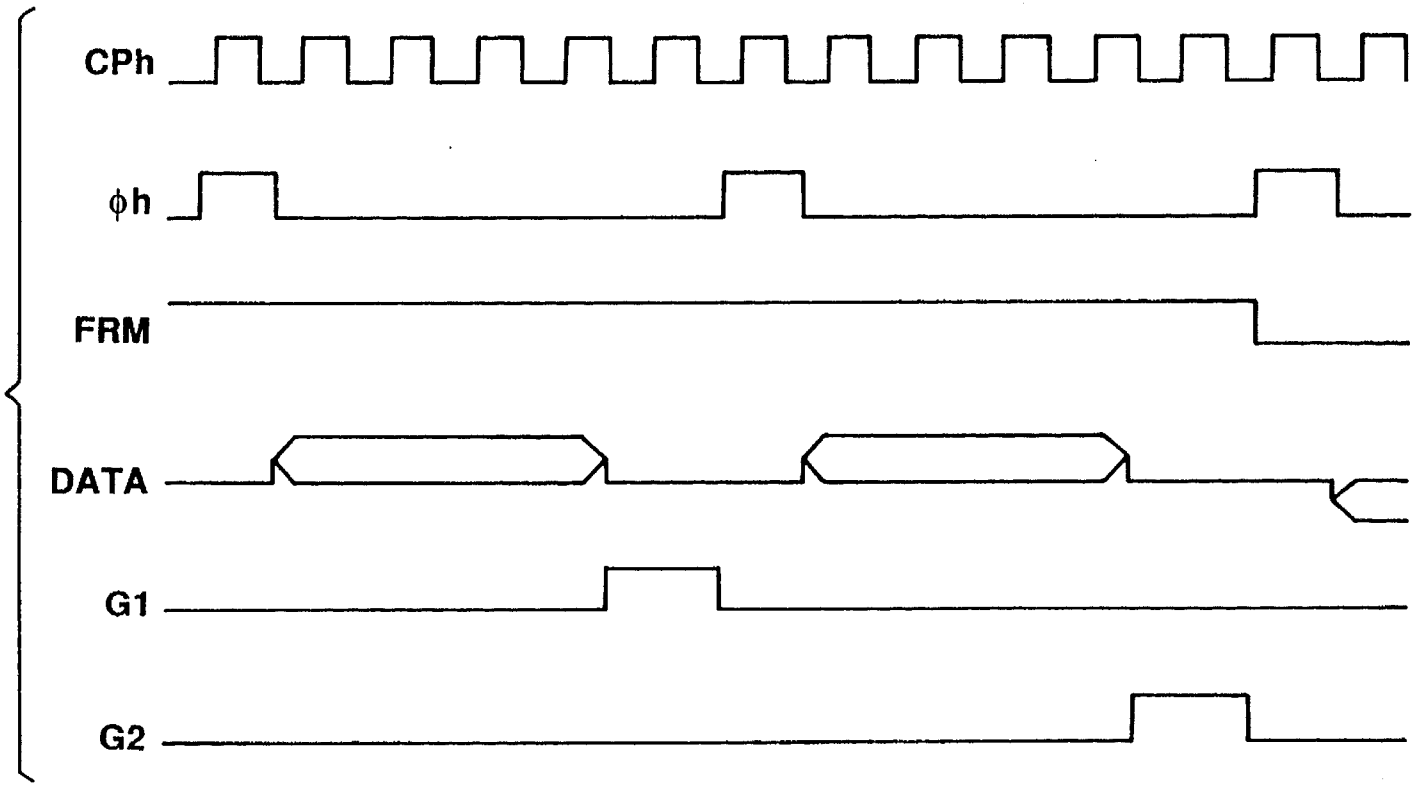
PRIOR ART FIG. 6
FIG. 6 is a timing chart showing of the timings of driver signals for components of the drive circuit of FIG. 5.

FIG. 4 shows an embodiment of a combination of the latch circuit LA201 and the tristate output circuit TS201 of FIG. 1.

In FIG. 4, invertors are indicated at IN1 to IN6, and transfer gates at TG1 and TG2, and MOS (metal oxide semiconductor) thin-film transistors at TR1 to TR8. The thin-film transistors TR1, TR2, TR4 and TR7 are of the P-channel type. The thin-film transistors TR3, TR5, TR6 and TR8 are of the N-channel type.

In operation of the circuit of FIG. 4, once the invertor IN1 of the latch circuit LA201 receives the signal $\overline{LAT}$, the transfer gate TG1 opens so that the latch circuit LA201 latches an image data DATA. Once the image data DATA is low, both the P-MOS transistor TR1 and the N-MOS transistor TR3 are turned on. Thereby, both the P-MOS transistor TR7 the gate of which receives a voltage $\overline{Vcc}$ via the P-MOS transistor TR1 and the N-MOS transistor TR8 the gate of which receives ground potential via the N-MOS transistor TR3 are turned off. Thereby, the tristate output circuit TS201 applies zero voltage to the data line L201 regardless of the state of the frame signal FRM.

Once the image data DATA latched by the latch circuit LA201 is high, the output of the tristate output circuit TS201 depends on the state (a high or low potential) of the frame signal FRM. In detail, once the image data DATA is high, both the P-MOS transistor TR2 and the N-MOS transistor TR5 are turned on. In this case, once the frame signal FRM is high, the N-MOS transistor TR6 is turned on and the P-MOS transistor TR4 is turned off. Thereby, the N-MOS transistor TR8 the gate of which receives ground potential via the N-MOS transistor TR6 is turned off and the P-MOS transistor TR7 the gate of which receives ground potential via the N-MOS transistor TR6, the N-MOS transistor TR5 and the P-MOS transistor TR2 is turned on. Thereby, the tristate output circuit TS201 provides the high potential $V_{OH}$ to the data line L201.

Once the image data DATA latched by the latch circuit LA201 is high and the frame signal FRM is low, the P-MOS transistor TR4 is turned on and the N-MOS transistor TR6 is turned off. In this case, the gates of both the P-MOS transistor TR7 and the N-MOS transistor TR8 receive the power voltage Vcc, so that the P-MOS transistor TR7 is turned off and the N-MOS transistor TR8 is turned on. Thereby, the tristate output circuit TS201 provides the low potential $V_{OL}$ to the data line L201.

In sum, the respective tristate output circuits TS201 and TS202 provide the high potential $V_{OH}$ different from the high potential of the frame signal FRM to the data lines L201 and L202 once both the image data DATA and the frame signal FRM are high and on the other hand, the low potential $V_{OL}$ different from the low potential of the frame signal FRM to the data lines L201 and L202 once the image data DATA is high but the frame signal FRM is low. This configuration simplifies the display drive circuit. This will be described in detail hereinafter.

It is known that a lack of an alternating drive of liquid crystal accelerates a degradation of its quality. A drive voltage of liquid crystal generally is different from drive voltages of other circuits. For example, drive voltages of the image data DATA and the frame signals FRM are approximately 20 V and on the other hand, the high and low drive voltages of liquid crystal substantially are 15 V and 5 V where common potential $V_{COM}$ is 10 V. Accordingly, when the display drive circuit is configured to directly apply an alternating voltage to liquid crystal, the display drive circuit requires a provision of an alternating drive circuit for liquid crystal in addition to the frame signals FRM, so that the configuration of the display drive circuit is complicated. In the display drive circuit of FIG. 4, the tristate output circuit TS201 outputs the high potential $V_{OH}$ when the frame signal FRM is high, and the low potential $V_{OL}$ when the frame signal FRM is low. Thus, when the respective high potential $V_{OH}$ and low potential $V_{OL}$ are selected to be 15 V and 5 V, a use of the frame signals FRM can alternatingly drive the liquid crystal, which simplifies the configuration of the display drive circuit.

Operation of the display drive circuit according to the embodiment of the present invention will be described with reference to FIGS. 1 and 2 hereinafter.

The image data input terminal D of the flip-flop FF201 receives the image data DATA and the clock terminals of the flip-flops FF201 and FF202 receive the horizontal clock pulse $CP_h$. Then, the flip-flop FF201 sequentially transmits the image data DATA to the flip-flop FF202 and the flip-flop FF202 sequentially transmits the image data DATA to the subsequent flip-flop (not shown) and so forth. Every time the image data DATA for the single horizontal scanning line end, the control terminals $\overline{L}$ of the latch circuits LA201 and LA202 receive the latch signal $\overline{LAT}$ indicating the beginning of a next sequence of the image data DATA for the single horizontal scanning line. At the timing of the trailing edge of the latch signal $\overline{LAT}$, the latch circuits LA201, LA202 receive, latch the first sequence of the image data DATA for the single horizontal scanning line from the corresponding flip-flops FF201, FF202 and the output the first sequence of the image data DATA for the single horizontal scanning line. At the time the flip-flops FF201 and FF202 have completed receiving the first sequence of the image data DATA for the single horizontal scanning line, the flip-flop FF201 starts receiving the next sequence of the image data DATA for the single horizontal scanning line. The flip-flop FF201 transmits the next sequence of the image data DATA for the single horizontal scanning line to the flip-flop FF202. The flip-flop FF202 and the subsequent flip-flops transmit the next sequence of the image data DATA for the single horizontal scanning line. During transmission of the next sequence of the image data DATA for the single horizontal scanning line, the output terminals 0 of the respective latch circuits LA201 and LA202 continue providing the first sequence of the image data DATA for the single horizontal scanning line to the input terminals of the invertors IN201 and IN202 and the control terminals of the tristate output circuits TS201 and TS202.

As described above, once the outputs of the latch circuits LA201 and LA202 are at the high potential and the frame signal FRM is high, the tristate output circuits TS201 and TS202 output the high potential $V_{OH}$. Once the outputs of the latch circuits LA201 and LA202 are at the high potential and the frame signal FRM is low, the tristate output circuits TS201 and TS202 provide the low potential $V_{OL}$.

Once the outputs of the latch circuits LA201 and LA202 are low, the tristate output circuits TS201 and TS202 are off. In this case, the N-side control terminals of the transfer gates TG101 and TG102 receive the high potential and the P-side control terminals thereof receive the low potential. Thus the transfer gates TG101 and TG102 enable ground potential $V_{COM}$ to appear on the data lines L201 and L202.

For a period of time for which the latch circuits LA201 and LA202 output the first sequence of the image data DATA, i.e., a period of time for which the flip-flops FF201 and FF202 receive and transmit the next sequence of the image data DATA for the single horizontal scanning line to the subsequent flip-flops, the scanning shift register 13 provides the horizontal scanning signals G101 and G102 turning the thin-film transistors TFT on to the gate lines L301 and L302 via the invertors IN. Thus when the image data DATA is the high potential, the pixel capacitors LC store a charge via the thin-film transistors TFT. In this case, when the level of the frame signal FRM is inverted, the polarity of the voltage applied to the pixel capacitors LC is reversed.

As described above, since the latch circuits LA201 and LA202 concurrently receive the first sequence of the image data DATA for the single horizontal scanning line at the time the data line shift register comprising the flip-flops FF201 and FF202 has completed transmitting the first sequence of the image data DATA and the data line shift register transmits the next sequence of the image data DATA for the single horizontal scanning line when the latch circuits LA201 and LA202 output the first sequence of the image data DATA which have been latched to the data lines L201 and L202, the thin-film transistors TFT have an ample time for opening their gates. Thereby, the multistage configuration of the data line shift register can be obtained and therefore the definition of the display screen can be increased.

In the above embodiment, the period of time for opening the gates of the thin-film transistors TFT coincides with the period of time for the transmission of the image data DATA by the flip-flops FF201 and FF202. Either of the two periods of time may be shorter than the other. Components of the functional blocks of the display drive circuit are not limited to those of the above embodiment but may be in other forms.

The present invention is not rigidly restricted to the embodiment described above. It is to be understood that a person skilled in the art can easily change and modify the present invention without departing from the scope of the invention defined in the appended claims.

What is claimed is:

1. A liquid crystal display comprising:

a pair of spaced apart base plates;

a liquid crystal sealed in between said base plates;

a plurality of data lines and a plurality of address lines formed on a surface of one of said plates, said address lines intersecting said data lines;

a plurality of pixel electrodes placed near the intersections of said data lines and said address lines;

a plurality of switching devices each connected to one of said data lines, to one of said address lines and to one of said pixel electrodes;

peripheral circuit means comprising thin film transistors and formed on either of said base plates, said peripheral circuit means including:

shift circuit means for sequentially shifting digital image data for a single scanning line;

latch circuit means for latching said digital image data for a single scanning line;

frame signal supplying means for supplying a high frame voltage and a low frame voltage alternately to each of said data lines;

first switching means connected to said latch circuit means and to said frame signal supplying means for providing:

(i) a high drive voltage for said liquid crystal to said data lines when said digital image data is one of a high data voltage and a low data voltage and when one of said high frame voltage and said low frame voltage is applied, (ii) a low drive voltage for said liquid crystal to said data lines when said digital image data is one of said high data voltage and said low data voltage and when the other of said high frame voltage and said low frame voltage is applied, polarity, and (iii) no output when said digital image data is the other of said high data voltage and said low data voltage;

second switching means connected to said latch circuit means for providing a common voltage, independently of said high frame voltage and said low frame voltage, to said data lines when said digital image data is said other of said high data voltage and said low data voltage, said common voltage being substantially in the middle of said high drive voltage and said low drive voltage; and means for providing digital image data for a subsequent scanning line to said shift circuit means while said plurality of switching means are selectively driven to provide one of said high drive voltage, said low drive voltage and said common voltage to said data lines according to said digital image data for a current scanning line latched in said latch circuit means.

2. The liquid crystal display according to claim 1, wherein said first switching means of said peripheral circuit means comprises a tristate output circuit.

3. The liquid crystal display according to claim 2, wherein said high frame voltage and said low frame voltage input to said first switching means of said peripheral circuit means are respectively different from said high drive voltage and said low drive voltage output from said first switching means of said peripheral circuit means.

4. The liquid crystal display according to claim 3, wherein said high frame voltage input to said first switching means of said peripheral circuit means is higher than said high drive voltage output from said first switching means of said peripheral circuit means.

5. The liquid crystal display according to claim 1, wherein said second switching means of said peripheral circuit means comprises transfer gate means for opening and interrupting a communication between each of said data lines and a common potential line.

6. The liquid crystal display according to claim 2, wherein an input of said tristate output circuit comprises a frame signal.

7. A liquid crystal display, comprising:

a pair of spaced apart base plates;

a liquid crystal sealed in between said base plates;

a plurality of data lines and a plurality of address lines formed on a surface of one of said plates, said address lines intersecting said data lines;

a plurality of pixel electrodes placed near the intersections of said data lines and said address lines; and peripheral circuit means comprising thin film transistors and formed on either of said base plates, said peripheral circuit means including:

shift circuit means for sequentially shifting digital image data for a single scanning line;

latch circuit means for latching said digital is image data for a single scanning line;

frame signal supplying means for supplying a high frame voltage and a low frame voltage alternately to each of said data lines;

tristate output circuits, each having a control terminal supplied with said digital image data, an input terminal supplied with said high frame voltage and said low frame voltage, a high drive voltage terminal supplied with a high drive voltage, a low drive voltage terminal supplied with a low drive voltage, an output terminal connected with one of said data lines, and selecting means for selectively connecting one of said high drive voltage terminal and said low drive voltage terminal with said output terminal; and a plurality of first switching devices, each for electrically connecting said data line to a common voltage, provided independently of said high frame voltage and said low frame voltage, when neither said high drive voltage nor said low drive voltage is output from said output terminal of a respective said tristate output circuit, and for electrically disconnecting said data line from said common voltage when either said high drive voltage or said low drive voltage is output from said output terminal of the respective tristate output circuit, said common voltage being substantially in the middle of said high drive voltage and said low drive voltage.

8. The liquid crystal display according to claim 7, further comprising a plurality of second switching devices mounted on either of said base plates, each of said second switching devices being connected to one of said data lines and to one of said address lines.

9. The liquid crystal display according to claim 8, further comprising a plurality of pixel electrodes mounted on either of said base plates, each of said pixel electrodes being connected to a respective one of said second switching devices.

10. The liquid crystal display according to claim 9, wherein:

image data for a subsequent scanning line is provided to said shift circuit means while image data for a current single scanning line is latched in said latch circuit means; and wherein one of said high drive voltage, said low drive voltage and said common potential is supplied to each of said pixel electrodes through said first and said second switching devices.

* * * * *